United States Patent [19]

Klisch et al.

[11] 4,107,095

[45] Aug. 15, 1978

[54] LIQUID OLEFIN SULFONATE DETERGENT COMPOSITIONS CONTAINING ANTI-GELLING AGENTS

[75] Inventors: Stephen Cajetan Klisch, Somerset; Charles Andrew Martin, Morris Plains, both of N.J.

[73] Assignee: Colgate-Palmolive Company, New York, N.Y.

[21] Appl. No.: 350,268

[22] Filed: Apr. 11, 1973

[51] Int. Cl.[2] ..... C11D 1/14; C11D 3/34; C11D 17/08

[52] U.S. Cl. ..... 252/541; 252/153; 252/173; 252/545; 252/551; 252/552; 252/555; 252/557; 252/DIG. 14

[58] Field of Search ..... 252/536, 555, 538, 529, 252/153, 173, 541, 545, 551, 552, 557

[56] References Cited

U.S. PATENT DOCUMENTS

| | | | |
|---|---|---|---|
| 3,303,138 | 2/1967 | De Witt | 252/559 X |
| 3,544,475 | 12/1970 | Tomiyama | 252/555 |
| 3,554,916 | 1/1971 | Kerfoot | 252/558 X |
| 3,691,108 | 9/1972 | Ichiki | 252/555 |
| 3,708,437 | 1/1973 | Sweeney | 252/555 |
| 3,755,203 | 8/1973 | Bentley | 252/536 |
| 3,793,219 | 2/1974 | Kashiwa | 252/526 |
| 3,798,183 | 3/1974 | Bruson | 252/557 |
| 3,808,156 | 4/1974 | Gorsich | 252/555 X |
| 3,808,157 | 4/1974 | De Witt | 252/555 |

*Primary Examiner*—Dennis L. Albrecht

[57] ABSTRACT

Liquid detergent compositions are produced containing essentially a mixture of an olefin sulfonate, an alkanolamide foam booster and an aliphatic mono sulfonic acid salt having less than 5 carbon atoms.

4 Claims, No Drawings

LIQUID OLEFIN SULFONATE DETERGENT COMPOSITIONS CONTAINING ANTI-GELLING AGENTS

This invention relates to improved liquid detergent compositions which contain as their major ingredient an olefin sulfonate together with a fatty acid alkanolamide foam booster in an aqueous medium. The tendency of these compositions to form a gel on their surfaces upon standing is favorably and unexpectedly reduced by the inclusion of certain agents. These compositions are generally classed as light duty detergents and are particularly suitable for dishwashing and laundering fine fabrics.

According to one aspect of this invention there is provided a liquid detergent composition containing dispersed in aqueous medium, a ternary mixture of (a) a sodium alpha olefin sulfonate having an average of about 14 to 16 carbon atoms (b) an alkanolamide of about 12 to 14 carbon atoms, said alkanolamide being a monoethanolamide, a diethanolamide, an ethoxylated monoethanolamide or mixtures thereof and (c) a water soluble salt of an aliphatic mono sulfonic acid having less than 5 carbon atoms, the weight ratio of (a) to (c) being about 16:1 to about 2:1 preferably about 7:1 to about 3:1, e.g. about 4:1.

Preferred compositions of this invention may also contain, as an active ingredient, an ammonium salt of an ethoxylated alcohol sulfate which is the monosulfate of an ethoxylation product of an alkanol having an average of about 12 to 15 carbon atoms, said ethoxylation product having about 3 ethenoxy groups per alkanol moiety.

The detergent compositions of this invention have very good performance, such as evidenced, for instance by foaming power, foam characteristics, detergency, biodegradability, storability, low toxicity, desirable viscosity, resistance to gel formation and ready redissolution of any gel formed.

A particularly suitable olefin sulfonate for use in the compositions is the sulfonation product of an olefin mixture containing about 75–85% straight chain alpha olefin (e.g. olefin of the formula $R—CH{=}CH_2$ where R is aliphatic hydrocarbon), about 8 or 10 to 20% olefin in which the unsaturation is in a vinylidene group (e.g. olefin of the formula $$\begin{array}{c} R—C—R' \\ \| \\ CH_2 \end{array}$$

where R and R′ are aliphatic hydrocarbon groups preferably each having at least four carbon atoms), and about 5 to 12% internal olefin (e.g. olefin of the formula $R—CH{=}CH—R'$ where R and R′ are aliphatic hydrocarbon). One preferred method of preparing such an olefin mixture is by polymerization of ethylene with a Ziegler type catalyst to produce a mixture of alpha-olefins of various chain lengths, separating therefrom a fraction containing principally $C_{14}$ and $C_{16}$ alpha olefins and a fraction containing lower molecular weight alpha olefins (e.g. of 6 and 8 carbon atoms) and dimerizing the latter fraction and combining the first mentioned fraction with said dimerized fraction.

One particularly suitable olefin mixture has an average of about 14 to 15 (e.g. 14.2 to 14.7) carbon atoms. In a most preferred form the olefin mixture has less than 10% (e.g. below 5%, such as 2%) olefins of less than 14 carbon atoms and less than 10% (e.g. below 5%, such as 2%) olefins of more than 16 carbon atoms.

The sulfonation of the olefin may be effected with sulfur trioxide at low partial pressure thereof (e.g. a partial pressure below about 100 mm of mercury, preferably below about 25 mm of mercury). The $SO_3$ may be in gaseous form diluted with an inert diluent (e.g. air) or undiluted (in vacuum), it may also be in liquid form (e.g. in solution in $SO_2$ at low temperature, such as 0° C). The $SO_3$; olefin mol ratio is usually about 1:1 to 1.2:1, preferably less than about 1.12:1, such as about 1.05–1.1:1. The reaction product from the sulfonation may be then mixed with a 10–15% molar excess of aqueous caustic to effect neutralization of the sulfonic acids and heated to effect hydrolysis by ring opening of the sultones present as a major proportion of the reaction product. The resulting product typically contains by weight an amount of alkenyl sulfonate which is within the range of about 40 to 80% (preferably about 50 to 70%), an amount of hydroxyalkane sulfonate, which is within the range of about 15 to 70% (preferably 20 to 40%) about 5 to 12% by weight of hydroxyalkane disulfonate and alkene disulfonate and up to about 7% to about 15%, as impurities designated as sodium sulfate, free oil and sodium chloride. Sulfonation processes are described, for instance, in U.S. Pat. No. 3,462,525 issued Aug. 19, 1969 to Levinsky et al., U.S. Pat. No. 3,428,654 issued Feb. 18, 1969 to Rubinfeld et al., U.S. Pat. No. 3,420,875 issued Jan. 7, 1969 to DiSalvo et al., U.S. Pat. No. 3,506,580 issued Apr. 14, 1970 to Rubinfeld et al., U.S. Pat. No. 3,579,537 issued May 18, 1971 to Rubinfeld et al., and U.S. Pat. No. 3,524,864 issued Aug 18, 1970 to Rubinfeld et al.

It is also within the broader scope of the invention to use other olefins as the raw material, e.g., olefins made by cracking petroleum wax, substantially pure α-olefins made by polymerization of ethylene, and olefins made by dehydration of higher alcohols having the average chain lengths and distributions of molecular weights described above. Also, the average carbon content may be, less preferably, outside the range of about 14–16 carbon atoms, e.g. 12, 13, 17 or 18 carbon atoms. The olefin sulfonate may also be wholly or partially in the form of a water soluble salt other than the sodium salt, such as potassium, ammonium, mono- di- or triethanolammonium salt or mixtures thereof.

The ethoxylated alcohol sulfate of the preferred compositions may be produced by ethoxylating with ethylene oxide a natural alcohol or a synthetic alcohol produced by Zeigler or Oxo process having from about 12 to 15 carbon atoms, preferably a primary alkanol, and thereafter sulfating this reaction product to form the monosulfate and then neutralizing to form the ammonium salt. It is also within the broader scope of the invention to use other salts, e.g. sodium or triethanolammonium salts and ethoxylation products having other degrees of ethoxylation (such as about 1 to 5 mols of ethylene oxide per mol of alkanol).

Typical suitable alkanols have the following distributions of carbon chains: 0.5% $C_{10}$, 33.6% $C_{12}$, 0.6% $C_{13}$, 61.1% $C_{14}$, 0.1% $C_{15}$, 3.6% $C_{16}$ and 0.4% post $C_{16}$; 0.7% $C_{10}$, 39.9% $C_{12}$, 2.5% $C_{13}$, 51.9% $C_{14}$, 1.4% $C_{15}$, 3.4% $C_{16}$ and 0.1% post $C_{16}$; 31.2% $C_{12}$, 1.8% $C_{13}$, 61.2% $C_{14}$, 1.6% $C_{15}$ and 3.6% $C_{16}$; 0.8% $C_{11}$, 18.7% $C_{12}$, 24.2% $C_{13}$, 32.3% $C_{14}$, 20.0% $C_{15}$ and 0.3% $C_{16}$. Such alcohol sulfates have a molecular weight of from 420 to 460, preferably from 430 to 440, e.g. about 435.

It is within the broader scope of the invention to use ethoxylated alcohol sulfates having an average of about 10 to 18 carbon atoms.

The second essential ingredient in the liquid detergent compositions consists of the monoethanolamide, diethanolamide or ethoxylated monoethanolamide of an alkanoic acid or a mixture of two or more of such amides.

A preferred alkanoic acid diethanolamide may be produced by reacting one mole of the alkanoic acid methyl ester with more than one mole (e.g. an excess of 5–10%) of diethanolamine in the presence of heat and a basic catalyst such as sodium methylate.

The ethoxylated monoethanolamide may be prepared by reacting one mole of the corresponding alkanoic acid monoethanolamide with 1 to 4, preferably one mole of ethylene oxide, in the presence of a basic catalyst such as sodium hydroxide.

Typical suitable alkanoic acids have the following distribution of carbon chains: 1% max. $C_{8-10}$, 71.2±2% $C_{12}$ 27.8±2% $C_{14}$ and 1% max. $C_{16}$.

Within the broader scope of the invention alkanoic acids having an average of about 8 to 18 carbon atoms may be employed.

The anti-gelling agent of the liquid detergent composition consists of the water-soluble salts of an organic sulfonic acid, preferably a mono-sulfonic acid, having less than 5 carbon atoms.

One preferred anti-gelling agent, trisodium sulfosuccinate, may be produced by reacting one mole of maleic anhydride with one mole of sodium hydroxide and one mole of sodium sulfite at 80°–100° C.

The olefin sulfonate or preferred mixture of water-soluble ethoxylated alcohol sulfate salts generally will be about 10 to 40% by weight of the liquid detergent composition and preferably about 25 to 35% by weight.

The proportion of alkanoic acid alkanolamide or alkanolamide mixtures in the detergent compositions generally will be an amount selected from the range of 0.5 to 8%, preferably 2 to 6% by weight which is sufficient to provide improved foam stability or improved foam volume. The proportion of anti-gelling salts in the detergent composition generally will be an amount in the range of from about 1 to 8%, preferably about 2% to 6%, e.g. about 4% by weight which is sufficient to reduce the tendency of the detergent compositions to form a gel-like skin and enhances the ability of the composition to readily redissolve any gel which is formed. This represents an important advance over prior art compositions in that gel formation leads to the plugging of nozzles or spouts of the containers used to dispense these liquid detergent compositions.

The following examples serve to illustrate the inventive detergent compositions. All concentrations in the examples are expressed in percent by weight unless otherwise indicated.

EXAMPLES 1–2

The following liquid detergent compositions are prepared.

| Ingredient | % | |
|---|---|---|
| *Sodium alpha olefin ($C_{14-16}$) sulfonate | 22.0 | 22.0 |
| **Ethoxylated ($C_{12-15}$ alcohol ammonium sulfate | 12.0 | 12.0 |
| ***Lauric-myristic diethanolamide | 5.0 | 5.0 |
| Trisodium sulfosuccinate | — | 3.2 |
| Magnesium sulfate heptahydrate | 2.0 | 2.0 |

-continued

| Ingredient | % | |
|---|---|---|
| Sodium gluconate | 0.1 | 0.1 |
| sodium citrate | 0.2 | 0.2 |
| Ethanol | 6.0 | 6.0 |
| Water | Bal. | Bal. |
| | 100.0 | 100.0 |

*A mixture of from 50% to 70% alkenyl sulfonate, 20% to 40% hydroxyalkane sulfonate and 5% to 12% of alkene disulfonate and hydroxyalkane disulfonate produced by sulfonating a $C_{14-16}$ olefin blend having a carbon distribution of 2.0% max. $C_{12}$, 66.2±2.0% $C_{14}$, 33.4±2.0% $C_{16}$, an average carbon chain length of 14.6, an average molecular weight of 205, a ratio of alpha olefin to vinylidene olefin of 6.4:1 and a ratio of alpha olefin to internal olefins of 9.6:1.

**An ethoxylated $C_{12-15}$ alcohol triethoxamer ammonium sulfate having a chain distribution of 0.8% $C_{11}$, 18.7% $C_{12}$, 24.2% $C_{13}$, 32.3% $C_{14}$, 20.0% $C_{15}$ and 0.3% $C_{16}$ and an average molecular weight of 436.

***Produced by reacting one mole lauric-myristic methyl ester with a molar excess (5–10%) of diethanolamine at elevated temperatures in the presence of sodium methylate catalyst. The acyl radical has a carbon chain distribution of 1% max. $C_{8-10}$, 71.2±2.0% $C_{12}$, 27.8±2.0% $C_{14}$ and 1% max. $C_{16}$.

The olefin sulfonate, water and alcohol are combined and mixed with low speed agitation at room temperature. To this mixture are added in order the formula amounts of lauric-myristic diethanolamide, trisodium sulfosuccinate, magnesium sulfate, sodium gluconate, sodium citrate, and ethoxylated alcohol ($C_{12-15}$) ammonium sulfate. The ingredients are mixed for about 5 minutes or until the mixture is uniform. The pH of the mixture is adjusted to 7.3±0.3 by the addition of acid or caustic as necessary and then the formula amount of hand care agent is added. Thereafter, color and perfume may also be added if desired. If necessary, the mixture may then be filtered to produce a clear product which may be placed in storage for future use. The formulations of Examples 1 and 2 are tested to determine the effect of the addition of an anti-gelling agent and its inhibitory effect on gel formation as follows: one ml. of the liquid formulation is allowed to run freely down a glass plate open to the atmosphere kept at a 30° angle from the horizontal. The distance which the liquid travels is measured and the nature of the path (straight or wavy) is observed.

A wavy line indicates that gel formation is taking place whereas a straight line indicates little or no gelling is occurring. The length of travel is an indication of the resistance to gel formation. The results indicate the relative gelling tendencies of the liquids which are shown in Table A.

TABLE A

| | Distance Traveled | Path Characteristics |
|---|---|---|
| Example 1 | 11⅝" | last 7½" wavy |
| Example 2 | 23⅛" | straight |

The above table shows that the addition of the trisodium sulfosuccinate increases resistance to gel formation.

EXAMPLES 3–7

The following liquid detergent compositions are prepared and comparatively tested as in Examples 1 and 2.

| Ingredient | % | | | | |
|---|---|---|---|---|---|
| *Sodium alpha olefin ($C_{14-16}$) sulfonate | 19.6 | 19.6 | 19.6 | 19.6 | 19.6 |
| **Ethoxylated ($C_{12-15}$) alcohol ammonium sulfate | 11.0 | 11.0 | 11.0 | 11.0 | 11.0 |
| ***Lauric-myristic diethanolamide | 5.0 | 5.0 | 5.0 | 5.0 | 5.0 |
| Trisodium sulfosuccinate | — | 1.6 | 3.2 | 4.8 | 4.8 |
| Ethanol | 8.0 | 7.0 | 7.0 | 7.0 | 5.0 |

-continued

| Ingredient | % | | | | |
|---|---|---|---|---|---|
| Water | Bal. | Bal. | Bal. | Bal. | Bal. |
| | 100.0 | 100.0 | 100.0 | 100.0 | 100.0 |

*,,* - As in Examples 1 and 2.

TABLE B

| Distance Traveled | Path Characteristics |
|---|---|
| Example 3 14 15/16" | last 9" wavy |
| Example 4 16 21/32" | last 9" wavy |
| Example 5 19 11/16" | last 9" wavy |
| Example 6 28 5/8" | straight |
| Example 7 23 3/16" | straight |

The above table shows that the addition of various amounts of trisodium sulfosuccinate increases resistance to gel formation.

EXAMPLES 8–11

The following liquid detergent compositions are prepared.

| Ingredient | | | | |
|---|---|---|---|---|
| *Sodium alpha ($C_{14-16}$) sulfonate | 16.1 | 16.1 | 16.1 | 16.1 |
| **Ethoxylated ($C_{12-15}$) alcohol ammonium sulfate | 13.8 | 13.8 | 13.8 | 13.8 |
| ***Lauric-myristic monoethanolamide | 0.5 | 1.0 | 2.0 | 3.0 |
| Hydroxyethyl ethylenediamine triaceticacid trisodium salt (hydroxy EDTA) | 0.2 | 0.2 | 0.2 | 0.2 |
| Magnesium sulfate heptahydrate | 1.0 | 1.0 | 1.0 | 1.0 |
| Sodium isethionate | 5.0 | 5.0 | 5.0 | 5.0 |
| Sodium xylene sulfonate | 0.4 | 0.8 | 1.6 | 2.4 |
| ****Water soluble protein | 1.0 | 1.0 | 1.0 | 1.0 |
| Ethanol | 3.0 | 3.0 | 3.0 | 3.0 |
| Water | Bal. | Bal. | Bal. | Bal. |
| | 100.0 | 100.0 | 100.0 | 100.0 |

* and ** - As in Examples 1 and 2

***Produced by reacting one mole of lauric-myristic fatty acid with one mole of monoethanolamine at elevated temperature. The acyl radical has a carbon chain distribution of 1% max. $C_{8-10}$, 71.2±2.0% $C_{12}$, 27.8±2.0% $C_{14}$ and 1% max. $C_{16}$.

****A partially hydrolyzed collagen protein having an average molecular weight of 1,000.

The olefin sulfonate, water and alcohol are combined and mixed with low speed agitation at room temperature. To this mixture are added in order, the formula amounts of lauric-myristic monoethanolamide, sodium xylene sulfonate, sodium isethionate, magnesium sulfate, hydroxy E.D.T.A. and ethoxylated alcohol ($C_{12-15}$) ammonium sulfate. The ingredients are mixed for about 5 minutes or until the mixture is uniform. The pH of the mixture is adjusted to 7.3±0.3 by the addition of acid or caustic as necessary and then the formula amounts of water-soluble protein is added. Thereafter color and perfume may also be added if desired. If necessary, the mixture may then be filtered to produce a clear product which may be placed in storage for future use.

EXAMPLES 12–18

The following liquid detergent compositions are prepared as in Examples 8–11.

| Ingredient | 12 | 13 | 14 | 15 | 16 | 17 | 18 |
|---|---|---|---|---|---|---|---|
| *Sodium alpha olefin ($C_{14-16}$) sulfonate | 16.1 | 16.1 | 16.1 | 16.1 | 16.1 | 16.1 | 16.1 |
| **Ethoxylated ($C_{12-15}$) alcohol ammonium sulfate | 13.8 | 13.8 | 13.8 | 13.8 | 13.8 | 13.8 | 13.8 |
| Ethoxylated cocomonoethanolamide | 1.0 | 2.0 | 4.0 | — | — | — | — |
| Ethoxylated lauric monoethanolamide | — | — | — | 1.0 | 3.0 | — | — |
| ****Lauric-myristic monoethanolamide | — | — | — | — | — | 2.0 | 1.5 |
| ***Lauric-myristic diethanolamide | — | — | — | — | — | 3.0 | 3.0 |
| "Hydroxy E.D.T.A." | 0.08 | 0.08 | 0.08 | 0.08 | 0.08 | 0.08 | 0.08 |
| Magnesium sulfate heptahydrate | 1.0 | 1.0 | 1.0 | 1.0 | 1.0 | 1.0 | 1.0 |
| Sodium allyl sulfonate | 5.0 | 5.0 | 5.0 | 5.0 | 5.0 | 4.0 | 4.0 |
| Sodium xylene sulfonate | — | — | — | — | — | 1.6 | 1.2 |
| *****Water soluble protein | 1.0 | 1.0 | 1.0 | 1.0 | 1.0 | 1.0 | 1.0 |
| Ethanol | 4.0 | 4.0 | 4.0 | 4.0 | 4.0 | 6.0 | 6.0 |
| Water | Bal. | Bal. | Bal. | Bal. | Bal. | Bal. | Bal. |
| | 100.0 | 100.0 | 100.0 | 100.0 | 100.0 | 100.0 | 100.0 |

*,,*,** and *** - As in Examples 1–11.

The liquid detergent compositions of Examples 8–18 are tested for resistance to gel formation using the procedures set forth in Examples 1 and 2. The compositions of Examples 8–18 are found to have increased resistance to gel formation due to the incorporation of anti-gelling agents.

The formulations of Examples 1–18 also provide detergent compositions having good foaming power, foam characteristics, detergency, biodegradability, storability, low toxicity, good viscosity and ready redissolution of any gel formed.

The proportion of the aqueous medium generally will be from about 30 to about 90%, preferably about 40 to 80% by weight of the liquid detergent. When present, the alcoholic solubilizer concentration will be about 1 to 10%, preferably 3 to 7%, by weight and the hydrotrope concentration will vary from about 0 to 6%, preferably 1 to 6% by weight, said weights being based upon the weight of the liquid detergent.

The liquid detergent compositions may also include from 0.25 to 3%, preferably 1 to 2%, by weight of a water-soluble substantive protein to reduce irritation of the skin on the fingers and hands of the user. Chemically, the protein ingredient is a low molecular weight polypeptide obtained by hydrolysis of protein materials such as human and animal hair, horns, hides, hoofs, gelation, collagen, and the like. During hydrolysis the proteins are gradually broken down into their constituent polypeptides and amino acids by prolonged heating with acids, e.g., sulfuric acid, or alkali, e.g., sodium hydroxide, or treatment with enzyme, e.g., peptidases. In hydrolysis, high molecular weight polypeptides are formed first and as hydrolysis proceeds these are converted progressively to simpler and simpler polypeptides to tripeptides, dipeptides, and finally to amino acids. It is obvious that the polypeptides derived from proteins are complex mixtures and in practice to the average molecular weight of the hydrolysis product will vary from 120 (amino acids) to about 20,000. All satisfactory hydrolyzed polypeptides are characterized by water solubility. In compositions which contain soluble protein it is preferred to use hydrolyzed collagen of such low molecular weight as to be completely soluble in water, non-gelling, and non-denaturing with an average molecular weight below 15,000, preferably in the range of about 500 to 10,000 with optimum results occurring at a molecular weight of about 1,000.

The ethoxylated alcohol sulfates of Examples 1–18 are readily available as commercial products such as ALFONIC 1412-A and NEODOL 25-3A. Commercial alkanoic acid monoethanolamides such as MONAMID LM-MA and EMID #6504 grade, commercial alkanoic acid diethanolamides such as TREPOLINE STD and MONAMID 150 LMW-C and commercial ethoxylated alkanoic acid monoethanolamides such as AMIDOX L-1 and AMIDOX C-1 may be used to advantage.

The active ingredient mixture and anti-gelling agent are generally solubilized in an aqueous medium to form a homogeneous liquid product. This aqueous medium may be water alone where the ingredients are sufficiently soluble or dispersible therein or it may consist of a mixture of water and an assistant solubilizer selected from the group consisting of $C_2$–$C_3$ monohydric alcohols and water-soluble salts or organic sulfonated or sulfated hydrotropes containing an alkyl group having up to six carbon atoms and mixtures thereof. Suitable alcohols include ethanol, propanol and isopropanol with ethanol being preferred. Suitable organic sulfonate hydrotropes include alkyl aryl sulfonates having up to 3 carbon atoms in the alkyl group such as sodium, potassium and ammonium toluene, xylene and cumene sulfonates. Suitable organic sulfate hydrotropes are the $C_5$–$C_6$ alkyl sulfate sodium, potassium, ammonium or mono-, di- and triethanolammonium salts.

The detergent compositions of the present invention may also include other conventional ingredients generally used in such formulations.

The preferred compositions of the subject application, however, are substantially free of builder salts. Water hardness salts such as magnesium sulfate and calcium chloride may be employed at concentrations of 0.5 to 4% by weight to enhance foaming in soft water. Sequestrants such as alkali metal citrates, gluconates and aminopolycarboxylates may be present in amounts from 0.1 to 1% by weight to sequester metallic ions such as iron found in wash water. Other adjuvants such as brighteners, colorants, emollients, perfumes, bacteriocides and the like may also be added to the detergent composition in concentrations up to about 2% by weight to improve various properties thereof.

In addition to the foregoing ingredients, the liquid detergent compositions may, less preferably, include minor proportions of other surfactants which do not adversely affect the composition's excellent characteristics. Such detergents generally will be present in amounts well below about 10%, preferably below about 5% of the total detergent content of the composition. Such detergents may be any compatible anionic, nonionic, amphoteric, zwitterionic and polar nonionic detergent which achieves good detergency, wetting or lathering characteristics or other advantageous detergent characteristics.

Suitable anionic detergents include the higher alkyl mononuclear aromatic sulfonates, such as the higher alkyl benzene sulfonates containing from 10 to 16 carbon atoms in the higher alkyl group in a straight or branched chain, for example, the sodium, potassium and ammonium salts of higher alkyl benzene sulfonates, higher alkyl toluene sulfonates, higher alkyl phenol sulfonates and higher naphthalene sulfonates; paraffin sulfonates containing about 10 to 20 carbon atoms, for example, the primary paraffin sulfonates are made by reacting long-chain alpha olefins bisulfites and paraffin sulfonates having the sulfonated group distributed along the paraffin chain as shown in U.S. Pat. Nos. 2,503,280, 2,507,088, 3,260,741, 3,372,188 and German patent 735,096; sodium and potassium sulfates of higher alcohols containing 8 to 18 carbon atoms such as sodium lauryl sulfate and sodium tallow alcohol sulfate; sodium and potassium salts of $\alpha$-sulfofatty acid esters containing about 10 to 20 carbon atoms in the acyl group, for example, methyl $\alpha$-sulfomyristate and methyl $\alpha$-sulfotallowate, ammonium sulfates of mono- or diglycerides of higher ($C_{10}$–$C_{18}$) fatty acids, for example, stearic monoglyceride monosulfate; sodium higher alkyl ($C_{10}$–$C_{18}$) glyceryl ether sulfonates; and sodium or potassium alkyl phenol polyethenoxy ether sulfates with about 1 to 6 oxyethylene groups per molecule and in which the alkyl radicals contain about 8 to about 12 carbon atoms.

Other suitable anionic surface active agents include the $C_8$ to $C_{18}$ acyl sarcosinates (for example sodium lauroyl sarcosinate); sodium and potassium salts of the reaction product of higher fatty acids containing 8 to 18 carbon atoms in the molecule esterified with isethionic acid; and sodium and potassium salts of the $C_8$ to $C_{18}$ acyl N-methyl taurides, for example, sodium cocoyl methyl taurate and potassium stearoyl methyl taurate.

Other types of surface active agents useful in the practice of the present invention are the nonionic synthetic organic detergents which are generally the condensation product of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

The nonionic detergents include the polyethylene oxide condensate of one mole of alkyl phenol containing from about 6 to 12 carbon atoms in a straight- or branched-chain configuration with about 5 to 30 moles of ethylene oxide, for example, nonyl phenol condensed with 9 moles of ethylene oxide, dodecyl phenol condensed with 15 moles of ethylene and dinonyl phenol condensed with 15 moles of ethylene oxide. Condensation products of the corresponding alkyl thiophenols with 5 to 30 moles of ethylene oxide are also suitable.

Also included in the nonionic detergent class are the condensation products of a higher alcohol (e.g. an alkanol) containing about 8 to 18 carbon atoms in a straight or branched-chain configuration condensed with about 5 to 30 moles of ethylene oxide, for example, lauryl-myristyl alcohol condensed with about 16 moles of ethylene oxide.

One useful group of nonionics is marketed under the trad name "Pluronics." The compounds are formed by condensing ethylene oxide with a hydrophobic base formed by the condensation of propylene oxide with propylene glycol. The molecular weight of the hydrophobic portion of the molecule is of the order of 950 to 4,000 and preferably 1,200 to 2,500. The addition of polyoxyethylene radicals to the hydrophobic portion tends to increase the solubility of the molecule as a whole. The molecular weight of the block polymers varies from 1,000 to 15,000, and the polyethylene oxide content may comprise 20 to 80% by weight.

Zwitterionic detergents such as the betaines and sulfobetaines having the following formula are also useful:

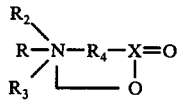

wherein R is an alkyl group containing about 8 to 18 carbon atoms, $R_2$ and $R_3$ are each an alkylene or hydroxyalkylene group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or non-functional substituents such as hydroxyl or halogen which do not substantially affect the hydrophobic character of the group. When X is C, the detergent is called a betaine; and when X is S:O, the detergent is called a sulfobetaine or sultaine. Preferred betaine and sulfobetaine detergents are 1-(lauryl dimethylammonio) acetate 1-(myristyl dimethylammonio) propane-3-sulfonate, and 1-(myristyldimethylammonio)-2-hydroxy-propane-3-sulfonate.

The polar nonionic detergents are those in which the hydrophilic group contains a semi-polar bond directly between two atoms, for example, N→O, As→O, and S→O. There is charge separation between the two directly bonded atoms, but the detergent molecule bears no net charge and does not dissociate into ions.

Among polar nonionic detergents are open-chain aliphatic amine oxides of the general formula $R_1R_2R_3N\rightarrow O$. For the purpose of this invention $R_1$ is an alkyl, alkenyl, or monohydroxyalkyl radical having about 10 to 16 carbon atoms, $R_2$ and $R_3$ are each selected from the group consisting of methyl, ethyl, propyl, ethanol, and propanol radicals.

Other operable polar nonionic detergents are the open-chain aliphatic phosphine oxides having the general formula $R_1R_2R_3P\rightarrow O$ wherein $R_1$ is an alkyl, alkenyl, or monohydroxyalkyl radical ranging in chain length from 10 to 18 carbon atoms, and $R_2$ and $R_3$ are each alkyl and monohydroxyalkyl radicals containing from 1 to 3 carbon atoms.

Examples of suitable ampholytic detergents include the alkyl beta-aminopropionates, $RN(H)C_2H_4COOM$; the alkyl betaiminodipropionates, $RN\ C_2H_4SO_3M$; and the long-chain imidazole derivatives having the following formulas:

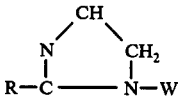

(I)

-continued

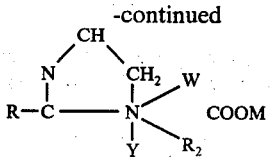

(II)

wherein R is an acyclic group of about 7 to 17 carbon atoms, W is selected from the group $R_2OH$, $R_2COOM$, and $R_2OR_2COOM$, Y is selected from the group consisting of $OH^-$, $R_3OSO_3^-$, $R_2$ is an alkylene or hydroxyalkylene group containing 1 to 4 carbon atoms, $R_3$ is selected from the group consisting of alkyl, alkyl aryl and fatty acyl glyceride groups having 6 to 18 carbon atoms in the alkyl or an acyl group; and M is a water-soluble cation, for example, sodium, potassium, ammonium, for alkylolammonium.

Formula I detergents are disclosed in Volume II of "Surface Active Agents and Detergents" and Formula II detergents are described in U.S. Pat. No. 2,773,068; U.S. Pat. No. 2,781,354; and U.S. Pat. No. 2,781,357. The acyclic groups may be derived from coconut oil fatty acids (a mixture of fatty acids containing 8 to 18 carbon atoms), lauric fatty acid, and oleic fatty acid, and the preferred groups are $C_7$ to $C_{17}$ alkyl groups. Preferred detergents are sodium N-lauryl beta-aminopropionate, disodium N-lauryl iminodipropionate, and the disodium salt of 2-laurylcyclomidium-1-hydroxyl, 1-ethoxyethanoic acid, 1 ethanoic acid.

Although the present invention has been described with reference to particular embodiments and examples, we wish it to be understood that we do not desire to be limited to the exact detail of such embodiments for obvious modification will occur to a person skilled in the art.

What is claimed is:

1. An aqueous, liquid detergent composition consisting essentially of from 25 to 35% by weight of a water-soluble salt of the reaction product of a sulfonated $C_{12}$–$C_{18}$ alpha olefin or a mixture of said reaction product salt and a water-soluble salt of a $C_{10}$–$C_{18}$ ethoxylated alcohol sulfate having 1 to 5 ethenoxy groups, said reaction product and sulfate salts being selected from the group consisting of sodium, potassium, ammonium and mono, di- and triethanolammonium salts, 0.5 to 8% by weight of a $C_8$–$C_{16}$ alkanoic acid ethanolamide selected from the group consisting of monoethanolamide, diethanolamide and ethoxylated monoethanolamide having 1 to 4 ethenoxy groups and from 2 to 6% by weight of an anti-gelling agent selected from the group consisting of a water-soluble salt of a sulfosuccinate or an allyl sulfonate, the weight ratio of olefin sulfonate to anti-gelling agent being about 16:1 to 2:1, in an aqueous medium, said composition being characterized by resistance to gel formation and ready dissolution of any gel formed.

2. The detergent of claim 1 wherein the gel inhibiting agent is trisodium sulfosuccinate.

3. The detergent composition of claim 1 wherein the olefin sulfonate has an average of about 14 to 16 carbon atoms and is produced by sulfonating an olefin mixture containing about 75 to 85% by weight straight chain alpha olefin, about 8 to 20% by weight vinylidene olefin and about 5 to 12% by weight internal straight chain olefin, with sulfur trioxide in a molar ratio of olefin mixture to sulfur trioxide of about 1:1 to 1.2:1 and subsequently neutralizing the sulfonated mixture and converting sultones therein to sulfonic acids by ring opening.

4. An aqueous, liquid detergent composition consisting essentially of from 25 to 35% by weight of a water-soluble salt of the reaction product of a sulfonated $C_{12}$–$C_{18}$ alpha olefin or a mixture of said reaction product salt and a water-soluble salt of a $C_{10}$–$C_{18}$ ethoxylated alcohol sulfate having 1 to 5 ethenoxy groups, said reaction product and sulfate salts being selected from the group consisting of sodium, potassium, ammonium and mono, di- and triethanolammonium salts, 0.5 to 8% by weight of a $C_8$–$C_{16}$ alkanoic acid ethanolamide selected from the group consisting of monoethanolamide, diethanolamide and ethoxylated monoethanolamide having 1 to 4 ethenoxy groups and from 1 to 8 % by weight of a water-soluble salt of an allyl sulfonate as an anti-gelling agent, the weight ratio of olefin sulfonate to anti-gelling agent being about 16:1 to 2:1, in an aqueous medium, said composition being characterized by resistance to gel formation and ready dissolution of any gel formed.

* * * * *